US009422758B2

(12) United States Patent
Zhong

(10) Patent No.: US 9,422,758 B2
(45) Date of Patent: Aug. 23, 2016

(54) HORIZONTAL DOOR CLOSER STRUCTURE

(71) Applicant: Yubo Zhong, Guangzhou (CN)

(72) Inventor: Yubo Zhong, Guangzhou (CN)

( * ) Notice: Subject to any disclaimer, the term of this patent is extended or adjusted under 35 U.S.C. 154(b) by 0 days.

(21) Appl. No.: 14/404,953

(22) PCT Filed: Nov. 8, 2013

(86) PCT No.: PCT/CN2013/086791
§ 371 (c)(1),
(2) Date: Dec. 2, 2014

(87) PCT Pub. No.: WO2014/161304
PCT Pub. Date: Oct. 9, 2014

(65) Prior Publication Data

US 2016/0002966 A1 Jan. 7, 2016

(30) Foreign Application Priority Data

Apr. 1, 2013 (CN) ..... 2013 2 0158676 U
Apr. 1, 2013 (CN) ..... 2013 2 0158767 U

(51) Int. Cl.

| | |
|---|---|
| ***E05F 3/02*** | (2006.01) |
| ***E05F 3/18*** | (2006.01) |
| ***E05F 5/08*** | (2006.01) |
| ***E05F 5/00*** | (2006.01) |
| ***E05F 1/16*** | (2006.01) |
| ***E05F 7/00*** | (2006.01) |

(52) U.S. Cl.
CPC ... *E05F 3/18* (2013.01); *E05F 1/16* (2013.01); *E05F 3/02* (2013.01); *E05F 5/003* (2013.01); *E05F 5/08* (2013.01); *E05F 7/005* (2013.01); *E05Y 2201/488* (2013.01); *E05Y 2900/14* (2013.01)

(58) Field of Classification Search
CPC ... Y10T 16/281; Y10T 16/286; Y10T 16/299; Y10T 16/27; Y10T 16/56; Y10T 16/585; Y10T 16/568; Y10T 16/62; Y10T 16/17; E05Y 2900/132; E05Y 2201/21; E05Y 2201/218; E05F 3/00; E05F 3/108; E05F 3/02; E05F 3/04; E05F 3/06; E05F 3/08; E05F 3/18; E05F 3/22; E05F 3/221; E05F 1/1016; E05F 1/1091
See application file for complete search history.

(56) References Cited

U.S. PATENT DOCUMENTS 2,953,811 A * 9/1960 Hall ..... E05F 3/02 16/66
3,072,954 A * 1/1963 Patriquin ..... E05F 3/02 16/66

(Continued)

FOREIGN PATENT DOCUMENTS

CN 2697253 Y * 5/2005

*Primary Examiner* — Chuck Mah

(57) ABSTRACT

The present invention provides a horizontal door closer structure, comprising an outer sleeve pipe and an inner pipe which can slide relatively, wherein an end of the outer sleeve pipe is provided with a buffer device, an adjustment component for adjusting total inlet and outlet air, and a buffer assembly are arranged on the buffer device; a spring is arranged in the inner pipe, one end of the spring is connected to the inner pipe, and the other end thereof is connected to the buffer device; and the front end of the outer sleeve pipe and an end of the inner pipe are provided with locating components which are mutually matched. In the door closer structure, the compression spring is arranged in the inner pipe, thereby saving the space of a door closer, and the adopted buffer device plays a buffering role by adjusting the total inlet and outlet air, and can control the speed of opening a door.

10 Claims, 8 Drawing Sheets

(56) References Cited

U.S. PATENT DOCUMENTS 3,105,264 A * 10/1963 Truhon ..... E05F 3/02 16/49
3,259,937 A * 7/1966 Kotikov ..... E05F 3/108 16/51
3,289,242 A * 12/1966 Mallory ..... E05F 3/02 16/66
3,376,795 A * 4/1968 Allen ..... F15B 15/1466 14/36
4,178,655 A * 12/1979 Little ..... E05F 1/1058 16/52
4,707,882 A * 11/1987 Watts ..... E05F 3/02 16/66
4,894,883 A * 1/1990 Fleischhauer ..... E05F 1/105 16/66
4,995,194 A * 2/1991 Schultze ..... E05F 3/04 16/58
5,163,204 A * 11/1992 Jackson ..... B63B 43/30 16/66
5,456,283 A * 10/1995 Schap ..... E05C 17/305 137/514.5
5,471,708 A * 12/1995 Lynch ..... E05F 3/02 16/66
5,727,286 A * 3/1998 Shen ..... E05F 3/02 16/49
6,317,922 B1 * 11/2001 Kondratuk ..... E05F 3/108 16/49
7,464,437 B2 * 12/2008 Song ..... E05F 3/10 16/51
7,657,970 B2 * 2/2010 Artsiely ..... E05F 5/02 16/82
8,051,534 B1 * 11/2011 Luca ..... E05F 3/02 16/66
2004/0150143 A1 * 8/2004 Zimmer ..... E05F 5/02 267/64.11
2009/0094789 A1 * 4/2009 Bereznai ..... E05F 5/10 16/84
2010/0307872 A1 * 12/2010 Wheeler ..... E05C 17/30 188/67
2011/0138573 A1 * 6/2011 Wu ..... E05F 3/108 16/66

* cited by examiner

HORIZONTAL DOOR CLOSER STRUCTURE

FIELD OF THE INVENTION

The utility model is relates to a door closer, particularly to a horizontal door closer structure.

BACKGROUND OF THE INVENTION

At present, most of the semi-automatic doors have damping devices for absorbing impact, and decreasing damage to doors. In general, prior art of horizontal doors contain an inner tube with a spring and an outer tube, the outer tube is needed to have a space for pressure spring, it virtually increases the size of horizontal door, besides, some hydraulic damping devices are often cause liquid leakage problem that is unreliable.

For those problems, the utility model provides a horizontal door closer structure.

SUMMARY OF INVENTION

The technical problem to be solved by the utility model is to overcome defects of the prior art, and provide a horizontal door closer structure.

The technical scheme of the utility model is a horizontal door closer structure comprising a relatively horizontal outer sleeve pipe (1) and an inner pipe (2), wherein the inner pipe (2) is arranged inside the outer sleeve pipe (1), and a front end thereof is extended outside the outer sleeve pipe (1), which is characterized in that the outer sleeve pipe (1) is provided with a buffer device (3) arranged in an rear end thereof, said buffer device (3) having an adjustment component (33) configured to adjust inlet and outlet air, and a buffer assembly; the inner pipe (2) is provided with a spring (21) therein, one end of the spring (21) connected to the inner pipe (2), and the other end thereof connected to the buffer device (3), thereby limited the inner pipe (2) in the outer sleeve pipe (1) by spring tension; a front end of the outer sleeve pipe (1) and a rear end of the inner pipe (2) respectively provided with locating components (41, 42) which are mutually matched.

Furthermore, the buffer device (3) comprises a base (31), a buffer seat (32) disposed inside the base (31) and the adjustment component (33) connected to a rear end of the base (31), a first air channel (34) and a second air channel (35) arranged between the base (31) and the buffer seat (32), the first air channel (34) and the second air channel (35) communicated with an external through the adjustment component (33); said buffer assembly disposed inside buffer seat (32) configured as a one-way valve for the first air channel (34); a thread of the adjustment component (33) connected to the rear end of the base (31) to adjust the second air channel (35), the buffer seat (32) and the adjustment component (33) having a buffer spring (36) arranged therebetween.

Furthermore, a conical surface (311) is disposed in an inner chamber of the base (31), and a cone-shape surface (321) mutually matched with the conical surface (311) is disposed in an outer wall of the buffer seat (32), the second air channel (35) formed between the conical surface (311) and the cone-shape surface (321).

Furthermore, the buffer seat (32) has a cone-shape chamber (322) formed therein, said cone-shape chamber (322) being configured to install the buffer assembly, and formed one part of the first air channel (34); said damping assembly comprising a steel ball (323) formed inside the cone-shape chamber (322) and a spring (324) configured to compress tightly the steel ball (323) in an rear end of the cone-shape chamber (322) by tension thereof.

Furthermore, the cone-shape chamber (322) has a through hole with a bigger front end than a rear end thereof, a circlip (325) arranged at the front end of the cone-shape chamber (322) and said spring (324) arranged between the steel ball (323) and the circlip (325).

Furthermore, the base (31) is respectively provided with an internal thread (312) connected with the adjustment component (33) and an external thread (310) connected with the outer sleeve pipe (1).

Furthermore, the adjustment component (33) is provided with an external thread (331) matched with the internal thread (312) of the base (31); the adjustment component (33) having a through aperture (332) configured to communicate with the first air channel (34) and the second air channel (35).

Furthermore, the base (31) is provided with a U-Shaped part (314) extended into the front end of the outer sleeve pipe (1) and connected to the spring (21).

Furthermore, locating components (41, 42) are defined as mutually attractive magnets; said magnet of the locating component (41) disposed inside the front end of the outer sleeve pipe (1), and the other magnet of the locating component (42) disposed at the rear end of the inner pipe (2); the inner pipe (2) extended outwardly at some distance to resist the spring tension, and then the two magnets of the locating components (41, 42) will fix the inner pipe (2) by attraction force.

Furthermore, the outer sleeve pipe (1) and the inner pipe (2) are further provided with a sealing element arranged therebetween.

Furthermore, the outer sleeve pipe (1) and the inner pipe (2) are further provided with a bearing arranged therebetween.

Compared with the prior art, the utility model has the beneficial effects are as followings:

The spring of the present invention is installed inside the inner tube, so it's not necessary to have additional space to place the spring, it effectively reduces length and size of horizontal door closer.

The buffer device of the present invention adopts air outlet and inlet adjustment to absorb the impact and the speed of the open and close door. The buffer device has the first air channel and the second air channel, which use the pressure difference to push the steel ball out of the first channel to make air inlet entering through the first air channel and the second air channel; when the air exhausted in reverse direction by the aid of the pressure difference and the spring tension, it will block the first air channel to make the air exhausted through the second air channel; besides, the second air channel can be adjusted effectively by the aid of the adjustment element, which efficiently controlled the air exhaust time and make a better buffer effect.

DETAILED DESCRIPTION OF THE PREFERRED EMBODIMENTS

Figure 1:
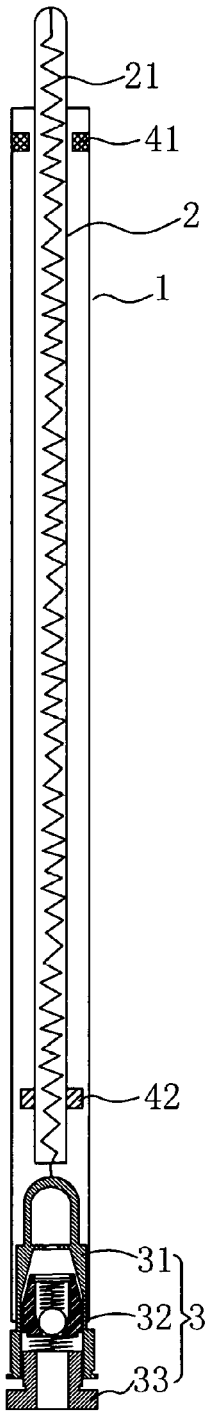
FIG. 1 is a cross-sectional view in the present invention.

As shown in FIG. 1-7, the utility model is a horizontal door closer structure comprising a relatively horizontal outer sleeve pipe (1) and an inner pipe (2), wherein the inner pipe (2) is arranged inside the outer sleeve pipe (1), and a front end thereof is extended outside the outer sleeve pipe (1), the outer sleeve pipe (1) is provided with a buffer device (3) arranged in an rear end thereof, said buffer device (3) having an adjustment component (33) configured to adjust inlet and outlet air, and a buffer assembly; the inner pipe (2) is provided with a spring (21) therein, one end of the spring (21) connected to the inner pipe (2), and the other end thereof connected to the buffer device (3) which can control the total air inlet and outlet of the outer sleeve pipe (1) to open the horizontal door automatically.

The outer sleeve pipe (1) and the inner pipe (2) have the spring (21) arranged therebetween, thereby limited the inner pipe (2) inside the outer sleeve pipe (1) through the spring tension. When the inner pipe (2) moved outwardly with some external forces to resist the spring (21) tension, the inner pipe (2) will-extend out of the outer sleeve pipe (1) at some distance until the matched locating components (41, 42) arranged respectively in the front end of the outer sleeve pipe (1) and the rear end of the inner pipe (2) are mutually engaged to fix and maintain the inner pipe (2) in protruding position.

The buffer device (3) comprises a base (31), a buffer seat (32) disposed inside the base (31), and the adjustment component (33) connected to a rear end of the base (31).

A first air channel (34) and a second air channel (35) formed between the base (31) and the buffer seat (32), the first air channel (34) and the second air channel (35) communicated with an external through the adjustment component (33).

The base (31) is connected to the rear end of the outer sleeve pipe (1), The base (31) including an inner chamber configured to receive the buffer seat (32), an opening (313) configured to communicate with an inner chamber of the outer sleeve pipe (1) and the inner chamber of the base (31), an internal thread (312) connected with a thread of the adjustment component (33) and an external thread (310) connected with a thread of the outer sleeve pipe (1).

The buffer seat (32) is disposed in the inner chamber of the base (31), the base (31) has a conical surface (311) disposed in the inner chamber thereof; the buffer seat (32) has a cone-shape surface (321) disposed in an outer wall thereof which is mutually matched with the conical surface (311), the second air channel (35) formed between the conical surface (311) and the cone-shape surface (321).

The buffer seat (32) has a cone-shape chamber (322) formed therein which is configured to install the buffer assembly, said cone-shape chamber (322) formed one part of the first air channel (34). Said buffer assembly comprising a steel ball (323) formed inside the cone-shape chamber (322) and a spring (324) configured to compress tightly the steel ball (323) in a rear end of the cone-shape chamber (322) by tension thereof. The cone-shape chamber (322) has a through hole with a bigger front end than a rear end thereof, a circlip (325) arranged at the front end of the cone-shape chamber (322) and said spring (324) arranged between the steel ball (323) and the circlip (325).

The adjustment component (33) having a thread connected to the rear end of the base (31) to adjust the second air channel (35), the buffer seat (32) and the adjustment component (33) having a buffer spring (36) arranged therebetween.

The adjustment component (33) is provided with an external thread (331) matched with the internal thread (312) of the base (31); the adjustment component (33) having a through aperture (332) configured to communicate with the first air channel (34) and the second air channel (35).

The base (31) is provided with a U-Shaped part (314) extended into the front end of the outer sleeve pipe (1) and connected to the spring (21).

The locating components (41, 42) are defined as mutually attractive magnets; said magnet of the locating component (41) disposed inside the front end of the outer sleeve pipe (1), and the other magnet of the locating component (42) disposed at the rear end of the inner pipe (2); the inner pipe (2) extended outwardly at some distance to resist the spring tension, and then the two magnets of the locating components (41, 42) will fix the inner pipe (2) by attraction force.

The outer sleeve pipe (1) and the inner pipe (2) are further provided with a sealing element arranged therebetween, so that the air will not discharge quickly and ensure having a good buffer effect.

Besides, the outer sleeve pipe (1) and the inner pipe (2) are further provided with a bearing arranged therebetween, so as to move smoothly.

Figure 2:
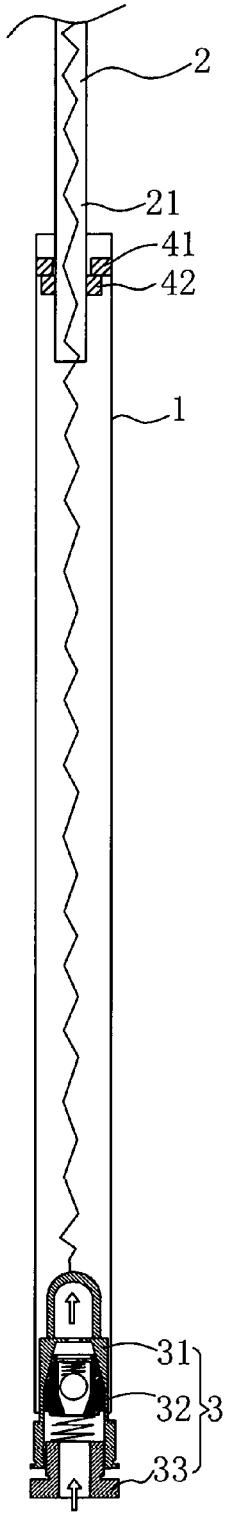
FIG. 2 is a cross-sectional view showing the inner tube being extended in the present invention.

The method of use in the present invention is as following:

When the horizontal door of the present invention is closed, the position of the inner pipe (2) as shown in FIG. 1 moved to other position as shown in FIG. 2, the inner pipe (2) is moved outwardly to resist the spring (21) tension by a force. At the moment, the air pressure inside the outer sleeve pipe (1) becomes lower than the outside air pressure, then the air entered according to an arrow direction as shown in FIG. 2 through the through hole (332) of the adjustment component (33), and pushed the steel ball (323) and opened the one-way valve of the first air channel (34) into the outer sleeve pipe (1) by air pressure difference. The inner pipe (2) keeps moving outwardly until the magnet of the rear end of inner pipe (2) attracts to the magnet of the front end of the outer sleeve pipe (1) to fix the inner pipe (2) for the door close. During the period of time, the air can only enter through the first air channel (34), and cannot enter through the second air channel (35), this is because the internal air pressure of the outer sleeve pipe (1) lower than outside air pressure, the air pressure will be on the buffer seat (32), and the buffer spring (36) will press on the buffer seat (32) simultaneously, thereby closed tightly between the conical surface (311) of the base (31) and the cone-shape surface (321) of the buffer seat (32), which only allow the first air channel (34) opened and the second air channel closed (35). As a result of the limitation for air intake quantity in the first air channel (34) by the buffer assembly, the speed rate of the air intake becomes slow to achieve some buffer effect, which slowed outwardly extending time for the inner pipe (2) and achieved the horizontal door to open smoothly.

Figure 3:
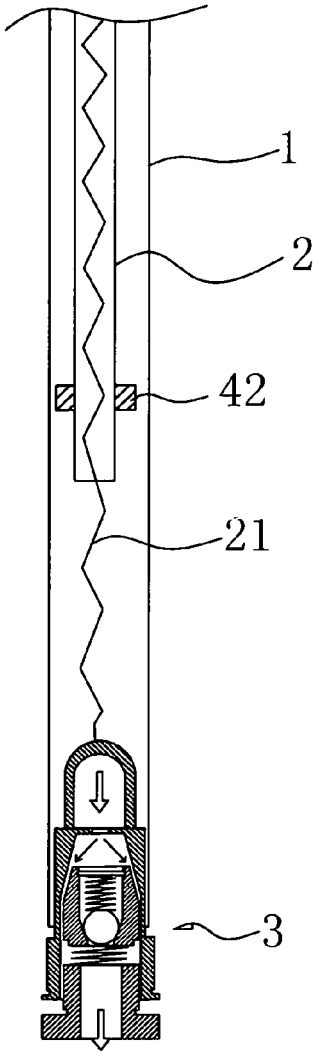
FIG. 3 is a cross-sectional view showing the inner tube moving back in the present invention.
Figure 4:
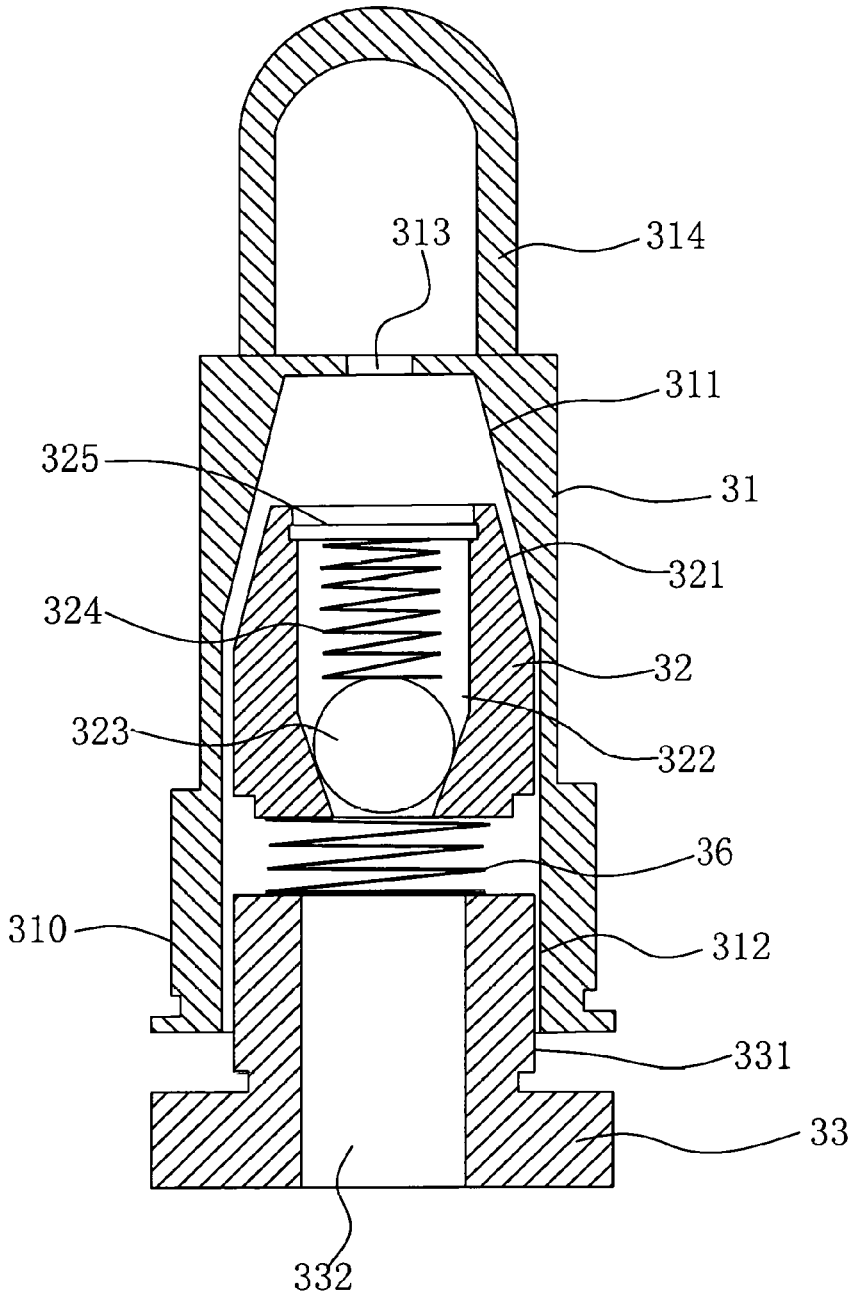
FIG. 4 is a cross-sectional view of damping device in the present invention.
Figure 5:
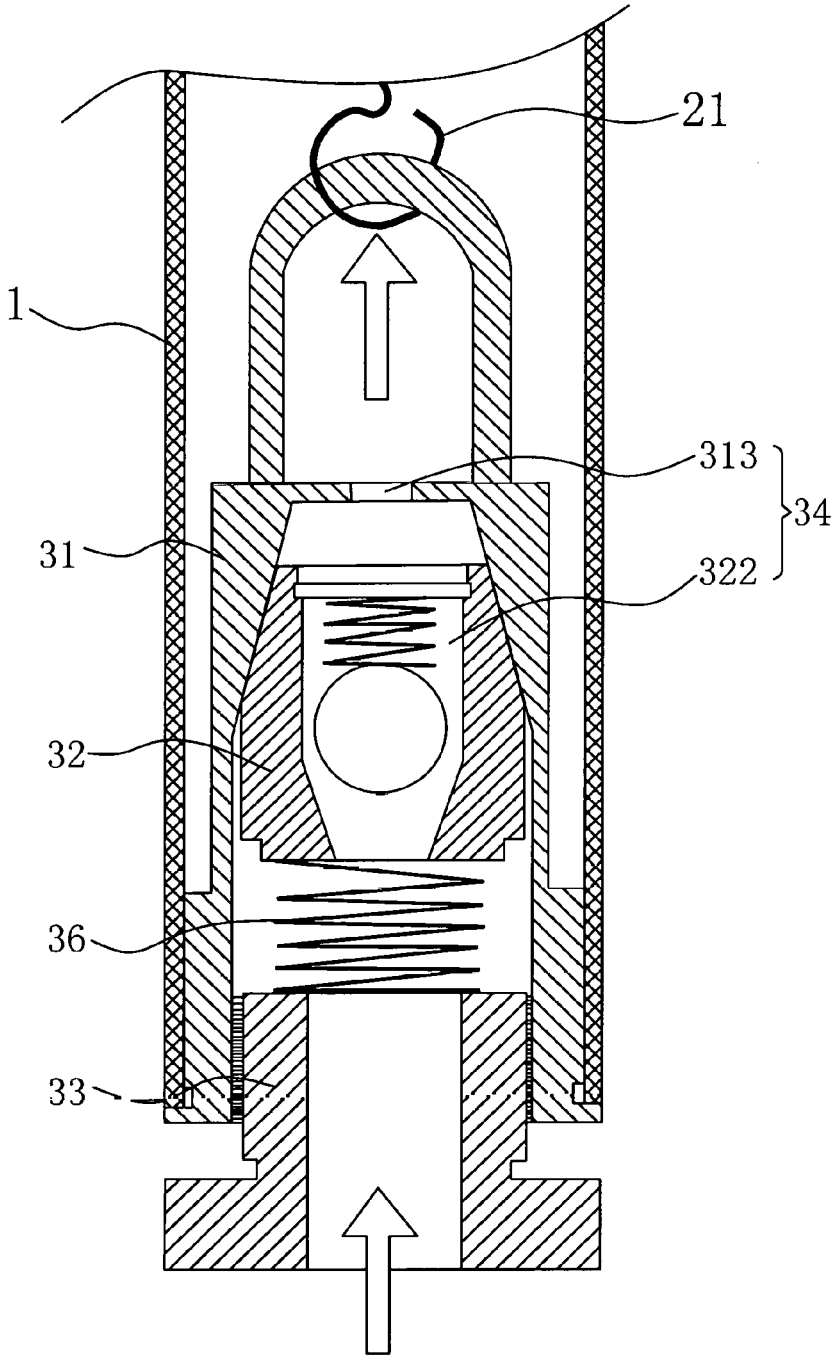
FIG. 5 is an operation schematic view showing the damping device being extended in the present invention.
Figure 6:
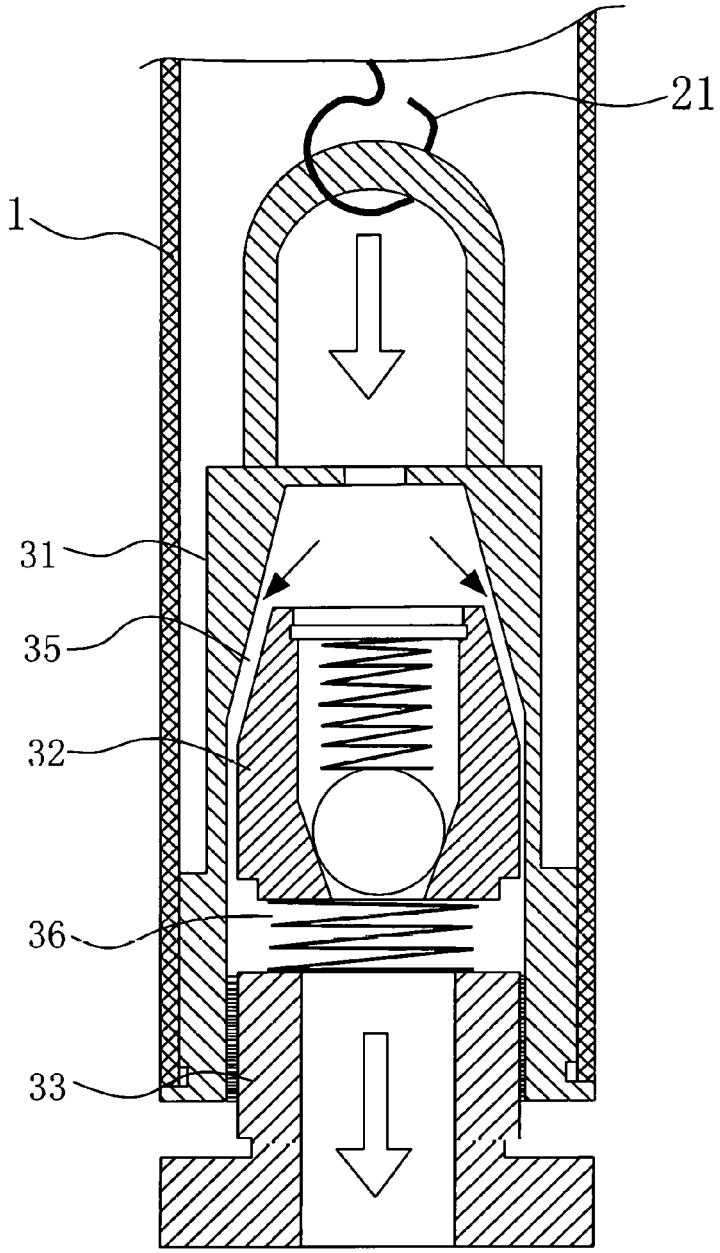
FIG. 6 is an operation schematic view showing the damping device moving back in the present invention.
Figure 7:
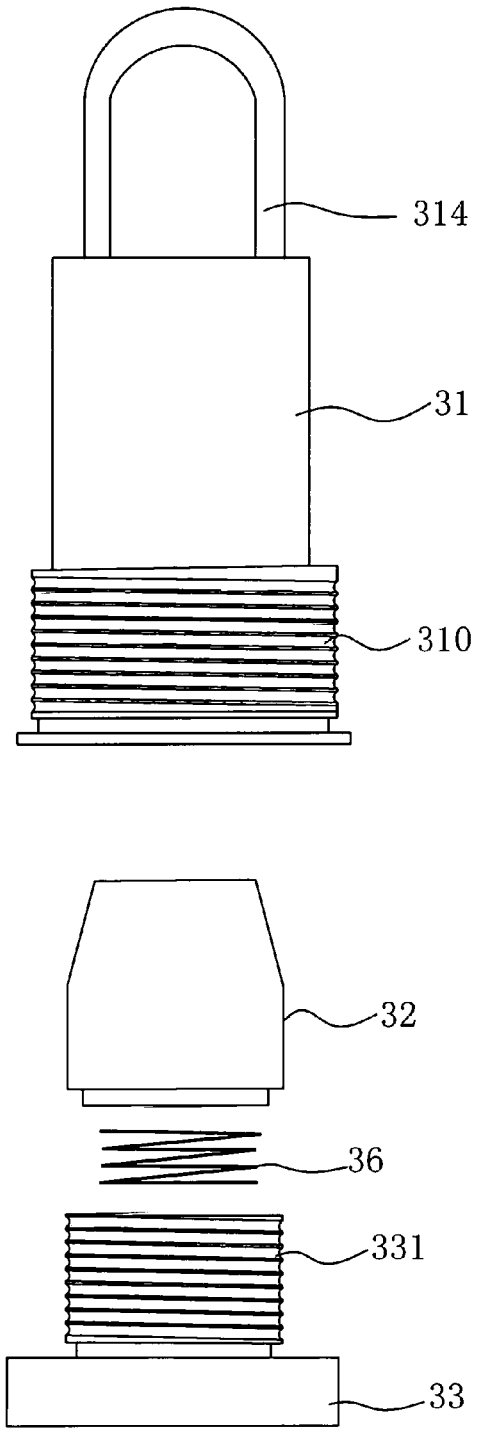
FIG. 7 is an exploded view of the damping device in the present invention.
Figure 8:
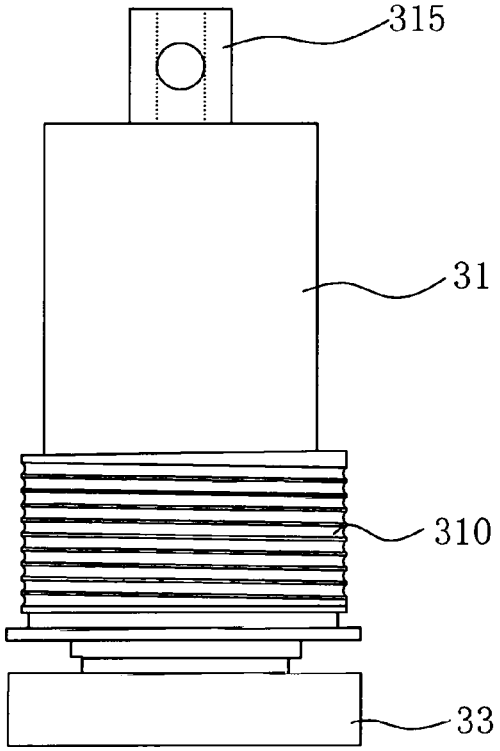
FIG. 8 is schematic view of the damping device of another embodiment in the present invention.

When the horizontal door is opened, the inner pipe (2) as shown in FIG. 2 and in FIG. 3 moves inwardly, the positioning component (41, 42) of the magnets are divided by a force. At the moment, the inner pipe (2) automatically return to initial position under the spring tension. With the inward movement of the inner pipe (2), the air pressure of the outer sleeve pipe (1) becomes higher than the outside air pressure and the pressure on the steel ball is disappeared, and then the steel ball blocks the cone-shape chamber (322) of the buffer seat (32) by the spring (324) force, thereby blocking the first air channel (34), resisting the spring (36) force, and forming a gap between the conical surface (311) of the base (31) and the cone-shape surface (321) of the buffer seat (32) that is the second air channel (35). The air will be exhausted from the through aperture (332) of the adjustment component (33) through the second air channel (35). As a result of the limitation of the exhaust quantity in the second air channel (35), the speed rate of the exhaust becomes slow to form some buffer effect and achieve the horizontal door returning smoothly.

Besides, the buffer spring (36) is disposed between the adjustment component (33) and the buffer seat (32), the space between the adjustment component (33) and the buffer seat (32) is smallest as the adjustment component (33) is totally screwed into the base (31). At the moment, the exhaust quantity of the second air channel (35) also becomes the smallest that increases the buffer time. If the adjustment component (33) screwed outwardly, the space between the adjustment component (33) and the buffer seat (32) becomes bigger, the force of the buffer spring (36) becomes smaller, and then the gap between the conical surface (311) of the base (31) and the cone-shape surface (321) of the buffer seat (32) becomes bigger, so as to control the second air channel (35) through the adjustment component (33), and further control the speed rate to open and close the horizontal door, which have a better buffer effect and decrease the broken chance for the slid horizontal ing door.

The base (31) is provided with a U-Shaped part (314) which can also change into an ear bar (315) structure. Said ear bar (315) can be formed integrally with the base.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. A horizontal door closer structure comprising a relatively horizontal outer sleeve pipe (1) and an inner pipe (2), wherein the inner pipe (2) is slidably arranged inside the outer sleeve pipe (1), and a front end thereof is extended outside the outer sleeve pipe (1), which is characterized in that the outer sleeve pipe (1) is provided with a buffer device (3) arranged in a rear end thereof, said buffer device (3) having an adjustment component (33) configured to adjust incoming airflow and outgoing airflow therethrough, and a buffer assembly;

the inner pipe (2) is provided with a spring (21) therein, one end of the spring (21) connected to the front end of the inner pipe (2), and the other end thereof connected to the buffer device (3), thereby keeping the inner pipe (2) in the outer sleeve pipe (1) through force of the spring (21); a front end of the outer sleeve pipe (1) and a rear end of the inner pipe (2) respectively provided with two locating components (41, 42) configured to interact with each other and prevent the inner pipe (2) from moving out of the outer sleeve pipe;

wherein the buffer device (3) comprises a base (31), a buffer seat (32) disposed inside the base (31), and the adjustment component (33) connected to a rear end of the base (31), a first air channel (34) and a second air channel (35) formed between the base (31) and the buffer seat (32), the first air channel (34) and the second air channel (35) communicated with an external through the adjustment component (33); said buffer assembly disposed inside the buffer seat configured as a one-way valve for the first air channel (34); the adjustment component (33) having a thread connected to the rear end of the base (31) to adjust the width of the second air channel (35), the buffer seat (32) and the adjustment component (33) having a buffer spring (36) arranged therebetween.

2. The horizontal door closer structure according to claim 1, characterized in that the base (31) has a conical surface (311) disposed in an inner chamber thereof; the buffer seat (32) has a cone-shape surface (321) disposed in an outer wall thereof which is mutually matched with the conical surface (311), the second air channel (35) formed between the conical surface (311) and the cone-shape surface (321).

3. The horizontal door closer structure according to claim 1, characterized in that the buffer seat (32) has a cone-shape chamber (322) formed therein which is configured to install the buffer assembly, said cone-shape chamber (322) formed one part of the first air channel (34); said buffer assembly comprising a steel ball (323) formed inside the cone-shape chamber (322) and an inner spring (324) configured to compress tightly the steel ball (323) in a rear end of the cone-shape chamber (322) by tension thereof.

4. The horizontal door closer structure according to claim 3, characterized in that the cone-shape chamber (322) is a through hole with a bigger front end than a rear end thereof, a circlip (325) arranged at the front end of the cone-shape chamber (322) and said inner spring (324) arranged between the steel ball (323) and the circlip (325).

5. The horizontal door closer structure according to claim 1, characterized in that the base (31) of the buffer device (3) is respectively provided with an internal thread (312) connected with the adjustment component (33) and an external thread (310) connected with the outer sleeve pipe (1).

6. The horizontal door closer structure according to claim 1, characterized in that the adjustment component (33) is provided with an external thread (331) matched with an internal thread (312) of the base (31); the adjustment component (33) having a through aperture (332) configured to communicate with the first air channel (34) and the second air channel (35).

7. The horizontal door closer structure according to claim 1, characterized, in that the base (31) of the buffer device (3) is provided with a U-Shaped part (314) extended towards the front end of the outer sleeve pipe (1) and connected to said other end of the spring (21).

8. The horizontal door closer structure according to claim 1, characterized in that the locating components (41, 42) are defined as mutually attractive magnets; one of the magnets of the locating component (41) disposed inside the front end of the outer sleeve pipe (1), and the other magnet of the locating component (42) disposed at the rear end of the inner pipe (2); the inner pipe (2) being extensible outwardly at some distance to resist the spring tension, and then the two magnets of the locating components (41, 42) will fix the inner pipe (2) by attraction force.

9. The horizontal door closer structure according to claim 1, characterized in that the outer sleeve pipe (I) and the inner pipe (2) are further provided with a sealing element arranged therebetween.

10. The horizontal door closer structure according to claim 1, characterized in that the outer sleeve pipe (1) and the inner pipe (2) are further provided with a bearing arranged therebetween.

* * * * *